US007316177B2

(12) United States Patent
Bakker et al.

(10) Patent No.: US 7,316,177 B2
(45) Date of Patent: Jan. 8, 2008

(54) HYDRAULIC HAND PUMP WITH LOCKING DEVICE

(75) Inventors: Travis Bakker, Alexandria, MN (US); Michael Landrum, Rockford, IL (US); Douglas Miller, New Berlin, WI (US)

(73) Assignee: SPX Corporation, Charlotte, NC (US)

( * ) Notice: Subject to any disclaimer, the term of this patent is extended or adjusted under 35 U.S.C. 154(b) by 26 days.

(21) Appl. No.: 11/396,678

(22) Filed: Apr. 4, 2006

(65) Prior Publication Data

US 2007/0227348 A1 Oct. 4, 2007

(51) Int. Cl.
*F15B 15/26* (2006.01)
*F04B 33/00* (2006.01)

(52) U.S. Cl. ..... 92/24; 92/15

(58) Field of Classification Search ..... 92/15, 92/20, 24, 25; 188/265; 303/89
See application file for complete search history.

(56) References Cited

U.S. PATENT DOCUMENTS 1,236,479 A * 8/1917 Peteler ..... 92/20
1,305,049 A * 5/1919 Bauer ..... 92/20
1,348,058 A * 7/1920 Service ..... 92/20
2,852,169 A * 9/1958 Kiffer et al. ..... 222/396
3,011,750 A * 12/1961 Johnson et al. ..... 251/5
3,746,403 A * 7/1973 Jones et al. ..... 303/89
3,787,087 A 1/1974 Buys et al. ..... 296/28 C
3,792,747 A 2/1974 Knutson ..... 180/89
D270,912 S * 10/1983 Sessody ..... D15/7
4,671,746 A 6/1987 Sessody ..... 417/437
4,976,372 A * 12/1990 Rogers, Jr. ..... 222/324
6,250,205 B1 * 6/2001 Chuang ..... 92/15
D463,452 S * 9/2002 Soderqvist ..... D15/7

* cited by examiner

*Primary Examiner*—Thomas E. Lazo
(74) *Attorney, Agent, or Firm*—Baker & Hostetler LLP

(57) ABSTRACT

A method and apparatus is provided that includes a hand pump having a handle locking mechanism, a counter bored nut, pivoting links, and unloading valve assembly. The unloading valve assembly allows a pump operator to pump a larger volume of hydraulic fluid and/or to pump to higher pressures in first stage operation than a conventional pump which employs a direct-acting relief valve. The unloading valve also decreases the effort required to pump the handle during second stage operation. The handle locking mechanism allows the pump handle from moving during transporting and storing of the hand pump. The counter bored nut allows for more reservoir room than conventional hand pumps. The pivoting link allows for greater leverage of the handle during pumping.

20 Claims, 5 Drawing Sheets

HYDRAULIC HAND PUMP WITH LOCKING DEVICE

CROSS-REFERENCE TO RELATED APPLICATIONS

This application claims priority to U.S. patent application entitled "Hydraulic Hand Pump," filed Oct. 28, 2005, having a Ser. No. 11/260,185, which claims priority to provisional U.S. patent application entitled "Hand Pump with Unloading Valve," filed Oct. 29, 2004, having a Ser. No. 60/622,798, the disclosure of which is hereby incorporated by reference in its entirety.

FIELD OF THE INVENTION

The present invention relates generally to a hydraulic hand pump. More particularly, the present invention relates to a hydraulic hand pump with a handle locking mechanism.

BACKGROUND OF THE INVENTION

Hand pumps containing hydraulic fluid are often used to pressurize hydraulic piston/cylinder assemblies in order to exert high forces on objects by pumping a handle on the pump. A piston/cylinder assembly can be attached to the hand pump to lift heavy objects, such as a vehicle. The hand pump includes an outlet that is connected to an inlet of the piston/cylinder assembly in order to transfer the hydraulic fluid from the pump to the piston/cylinder assembly. In order to lift the vehicle, the piston/cylinder assembly is placed under a frame of the vehicle and an operator operates the handle to pump the fluid under pressure. The pumping moves hydraulic fluid from a reservoir to the pump's outlet and finally to the piston/cylinder assembly. As the operator pumps, the pressure in the piston/cylinder assembly increases and thus, the piston/cylinder assembly will extend and be able to raise the vehicle.

One type of hand pump is the two-stage hand pump, which moves the hydraulic fluid in two stages. The two-stage hand pump may have a piston cylinder that includes a low and high pressure portions. In the first stage, both the low and high pressure portions contribute to moving the hydraulic fluid from the reservoir to the pump's outlet and to the piston/cylinder assembly. In the second stage, only the high pressure portion contributes to moving the hydraulic fluid to the piston/cylinder assembly while the low pressure portion returns the hydraulic fluid back to the reservoir. During the second stage, the conventional hand pump utilizes a direct-acting relief valve to relieve the low pressure portion and return fluid back to the reservoir. However, the use of the direct-acting relief valve is inefficient because during the second stage, every stroke of the hand pump requires additional effort by the operator to open the relief valve. Additionally, using a direct-acting relief valve can decrease the oil volume and pressure that can be delivered in the first stage.

A conventional two-stage pump limits the distance between the pivot point in the handle and the piston. Because the distance is limited, the mechanical advantage of the handle is not as great and the handle requires more effort to pump. Additionally, the conventional two-stage hand pump also includes a tie rod nut that protrudes from the housing. Because the tie rod is on the outside surface, the overall length of the pump is increased without increasing the oil reservoir capacity of the pump. Further, conventional hand pumps may or may not have a locking device to lock down the handle. Some handle locks may be awkward to use or prone to damage or misplacement because they are not integral with the pump. Accordingly, it is desirable to provide a hand pump that requires little or no additional pumping force during the second stage in order to return the first stage fluid back to the reservoir. It is also desirable to have a handle with a wider range of movement and to include a handle lock that is easy to use and integral to the pump construction so it is protected from damage and will not be lost. Additionally, it is desirable to have a tie rod nut that does not protrude from the rest of the pump so as to minimize the length of the pump while maximizing the capacity of the pump reservoir.

SUMMARY OF THE INVENTION

The foregoing needs are met, to a great extent, by the present invention, wherein in one aspect an apparatus is provided that in some embodiments can include a two-stage hand pump having an unloading valve assembly.

In accordance with an embodiment of the present invention, a hand pump having a locking mechanism that includes a handle pivotably attached to a housing of the pump and having a handle head, a lock plunger at least partially received within the handle head and having a locking end, and a lock screw having a head portion that can interact with the locking end of the lock plunger and is at least partially received in the housing, wherein the locking end can interact with the head portion of the lock screw to prevent the handle from moving away from the housing. The head portion of the lock screw can be received within the handle head and the locking end of the lock plunger can interact with a lower portion of the head screw to prevent the handle from moving. The lock plunger can be rotatable and retractable in order to prevent the locking end of the lock plunger from interacting with the head portion of the lock screw. Additionally, the lock plunger can be retractable so that when retracted, the locking end of the lock plunger can be prevented from interacting with the head portion of the lock screw. The locking end of the lock plunger can include a flat surface to interact act with the head portion of the lock screw and can interact with the head portion of the lock screw within the handle head. Further, the lock screw includes threads on the outer surface that mates with threads in the housing.

In accordance with another embodiment of the present invention, a handle locking method for a hand pump that can include moving a handle towards a housing of the hand pump to a lock position, moving a lock plunger in a first direction to engage a lock screw that is partially received in the housing, and locking the handle with a locking end of the lock plunger that engages the lower portion of the lock screw. The method can also include moving the lock plunger in a second direction to disengage the lock plunger from the lock screw. The lock plunger can include a flat surface to interact act with a head portion of the lock screw and the locking end of the lock plunger can interact with the head portion of the lock screw within a handle head.

In accordance with still another embodiment of the present invention, a hand pump with a locking system can include a means for pumping that is pivotably attached to a means for housing of the pump and having a head means, a means for locking at least partially received within the head means and having a locking end and a means for securing having a head portion that interacts with the locking end of the means for locking and is partially received in the means for housing, wherein the locking end can interact with the head portion of the means for securing to prevent the means for pumping from moving away from the housing. The head portion of the means for securing may be received within the head means. The locking end of the means for locking may interact with a lower portion of the head portion of the means for securing to prevent the means for pumping from moving. Additionally, the means for locking can be rotatable and retractable in order to prevent the locking end of the means for locking from interacting with the head portion of the means for securing and the means for locking can be retractable so that when retracted, the locking end of the means for locking can be prevented from interacting with the head portion of the means for securing. The locking end of the means for locking can include a flat surface to interact act with the head portion of the means for securing and can interact with the head portion of the means for securing within the head means. The means for securing can include threads on the outer surface that mates with threads in the means for housing.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
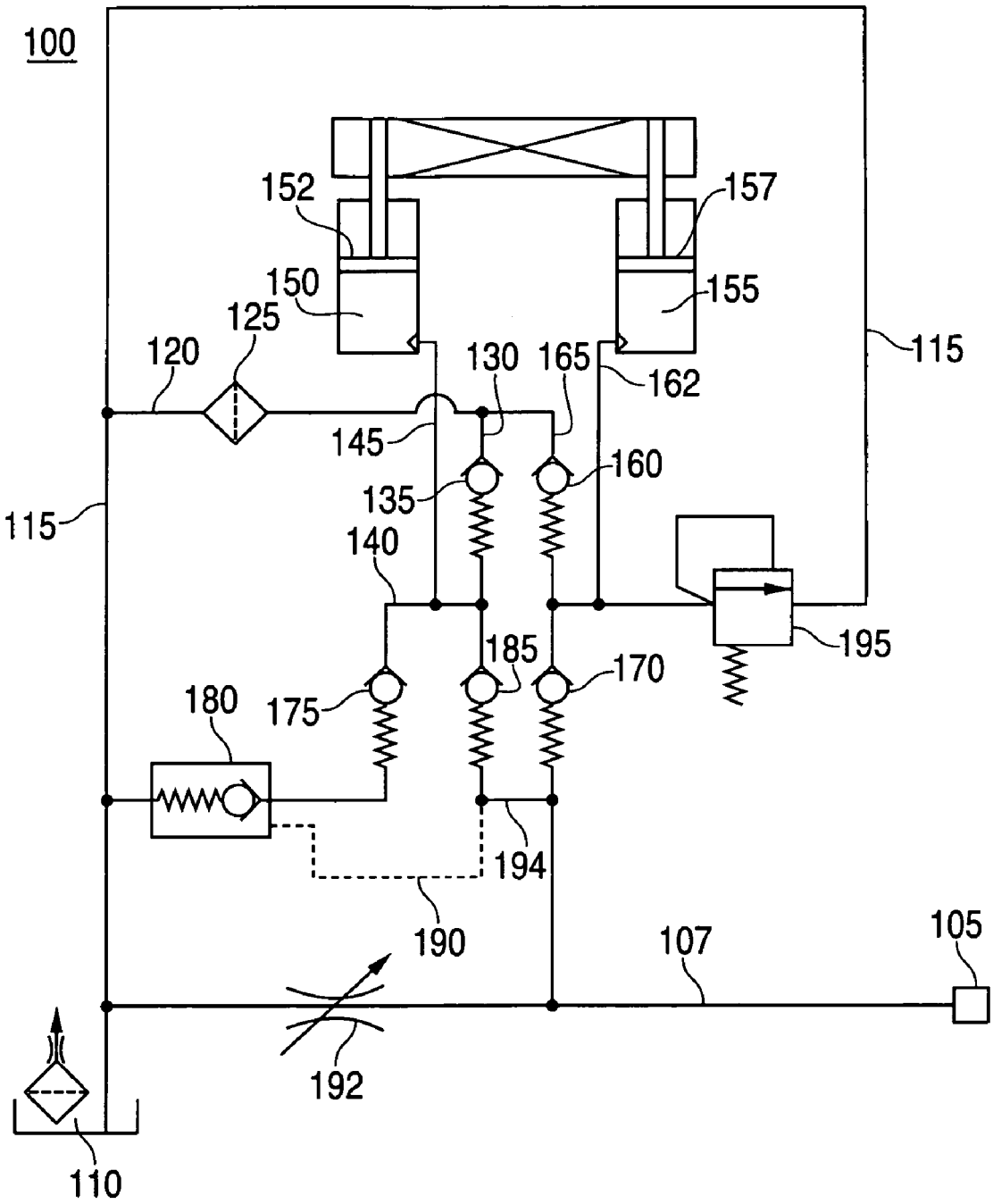
FIG. 1 is a hydraulic schematic diagram of a two-stage hand pump according to a preferred embodiment of the invention.

The invention will now be described with reference to the drawing figures, in which like reference numerals refer to like parts throughout. An embodiment in accordance with the present invention provides a hand pump having a handle locking mechanism, a counter bored nut, pivoting links, and unloading valve assembly. The unloading valve assembly allows a pump operator to pump a larger volume of hydraulic fluid and/or to pump to higher pressures in first stage operation than a conventional pump that employs a direct-acting relief valve. The unloading valve also decreases the effort required to pump the handle during the second stage operation. The handle locking mechanism allows the pump handle from moving during transporting and storing of the hand pump. The counter bored nut allows for more reservoir room than conventional hand pumps. The pivoting link allows for greater leverage of the handle during pumping.

FIG. 1 is a hydraulic system schematic diagram 100 of a two-stage hand pump. Hydraulic fluid is stored in a reservoir 110, which is connected to, and in fluid communication with, a passage 115 for fluid transfer to the hydraulic system. Passage 115 is connected to, and in fluid communication with, passage 120, which includes a filter 125 for filtering any contaminants from the fluid. Contaminants in the hydraulic system can damage the pump, for example, by degrading seals and creating leak paths in seals and hydraulic seats. Passage 120 intersects and communicates with passages 130 and 165. Passage 130 further includes a low pressure inlet check valve 135 and a low pressure outlet check valve 185, both having a spring, gravity, and/or pressure biasing a check ball towards a closed position. Similarly, passage 165 includes a high pressure inlet check valve 160 and a high pressure outlet check valve 170, both having the spring, gravity, and/or pressure biasing the check ball towards the closed position. As in any valve shown herein, the valves are designed to open when the pressure exceeds the force asserted on the check ball by a spring, gravity, and/or pressure.

Passage 130 is also in fluid communication with passage 140, which includes a back flow check valve 175 that allows the fluid to return from a low pressure piston chamber 150 through an unloading valve assembly 180 during a second-stage operation (discussed below). Passage 140 is in fluid communication with passage 145 which leads to the low pressure piston chamber 150 located below a low pressure piston 152. Upon raising the low pressure piston 152, a relative vacuum is created in the low pressure piston chamber 150, thereby the chamber 150 can fill with fluid from the reservoir 110 (discussed below).

Passage 165 is in fluid communication with passage 115, which also includes a high pressure relief valve 195. The high pressure relief valve 195 relieves pressure between a high pressure piston 157, high pressure inlet check valve 160, and the high pressure outlet check valve 170 in order to prevent damage to the hand pump or any system in fluid communication with the pump, when high pressure builds up in the pump, by allowing fluid to return to reservoir 110 via passage 115. Additionally, passage 115 is in fluid communication with passage 162, which communicates with a high pressure piston chamber 155 located below the high pressure piston 157. Upon raising the high pressure piston 157, a relative vacuum is created, thereby the high pressure piston chamber 155 can fill with fluid from the reservoir 110 (discussed below).

Near the low pressure outlet check valve 185 and the high pressure outlet check valve 170 is a passage 194, which communicates with passages 130 and 165. Passage 165 communicates with a pump outlet 105 and an oil return valve 192 through passage 107. The pump outlet 105 is where fluid under pressure exits from the hand pump in order to perform work on an attached device, such as a piston/cylinder assembly. The attached device can be any device that needs hydraulic fluid in order to perform the work. The piston/cylinder assembly herein can be a piston/cylinder assembly that is used to lift the vehicle in order to service it. The oil return valve 192 returns the fluid from the piston/cylinder assembly to the reservoir 110 once the desired work is completed. Dotted line 190 represents a pressure that is being asserted back from the piston/cylinder assembly. During second stage operation, the pressure is significant enough to move a piston 460 (See FIG. 4 and discussed further below), which in turn moves a spring-biased ball 465, in an unloading valve assembly 180 so that fluid from the low pressure piston chamber moving through the back flow check valve can return to reservoir 110. The movement of the ball 465 is limited by a physical stop 480 so as to be a means to prevent a spring 470 from being overly compressed and to prevent piston 460 from moving beyond its intended range. It should be noted that the back flow check valve can be part of the unloading valve assembly or separated from it.

In operation, during the first stage, the lifting of the handle (upstroke) moves both the low and high pressure pistons 152 and 157, which creates a relative vacuum in their respective low and high pressure chambers 150 and 155. Fluid from the reservoir 110 travels to the low pressure piston chamber 150, via passages 115 and 120, through the filter 125 and passage 130, through low pressure inlet check valve 135 and passage 140 and finally to passage 145. Fluid from the reservoir 110 travels to the high pressure piston chamber 155 in the similar pathway, as previously described, for the low pressure piston chamber 150 except that fluid from passage 120 flows to passage 165 and the high pressure inlet check valve 160, through the passage 115 and finally to passage 162.

Upon the handle being moved down (down stroke), the fluid from the low pressure piston chamber 150 travels through passage 145 to passage 140 and through passage 130 and the low pressure outlet check valve 185, through passage 194 which connects to passage 165 that is in communication with passage 107 and finally to the pump outlet 105. The fluid from the high pressure piston chamber 155 travels through passage 162 to passage 115, down passage 165 and through the high pressure outlet check valve 170 that is in communication with passage 107 and finally to the pump outlet 105. This continues until the first stage is completed. In our piston/cylinder assembly example, the first stage would be completed when the piston/cylinder assembly engages the vehicle, and now needs high pressure fluid in order to move the vehicle off of its tires for servicing.

Then during the second stage, since high pressure fluid is needed to perform the work of lifting the vehicle, the fluid in the low pressure piston chamber 150 is returned to the reservoir 110. The fluid from the high pressure piston chamber 155 travels to the pump outlet 105 as previously stated above in order for the piston/cylinder assembly to perform work. However, the high pressure shown in line 190 that is being exerted moves the piston 460 (FIG. 4) that moves the ball 465 (FIG. 4) of the unloading valve assembly 180, which allows fluids from the low pressure piston chamber to move therethrough and back to the reservoir 110. Therefore, during the second stage, the fluid in the down stroke flows from the low pressure piston chamber 150 through the passage 145 and passage 140, through the back flow check valve 175 and the now opened unloading valve assembly 180 to the passage 115 and finally to the reservoir 110. Pressure (due to high pressure build up from the piston/cylinder assembly) in lower part of passage 130 biases the ball of the low pressure outlet check valve 185 so fluid that normally flows through there from the low pressure piston reservoir, will instead be routed to the back through the back flow check valve 175. During the following up stroke, the back flow check valve 175 will prevent fluid or air from being drawn into the low pressure piston chamber 150 through the unloading valve assembly 180.

With the unloading valve assembly 180 allowing the fluid in the low pressure piston chamber 150 to return to the reservoir 110 with no extra effort in the down stroke of the pumping in the second stage, more fluid can be moved in first stage operation then had the pump used the direct acting relief valve to relieve pressure from the low pressure piston reservoir. Additionally, since the direct acting relief valve in conventional pumps will open during lower pressures, such as 200 p.s.i, not as much work can be accomplished in the first stage. In our embodiment, since the second stage does not occur until later, such as about 700 to 1200 p.s.i., more fluid can be moved by the low pressure piston before the second stage occurs. It should be noted that the unloading valve assembly can open lower or higher than the range specified herein.

Should the pressure in the high pressure piston reservoir 155 exceed a predetermined pressure, the high pressure relief valve 195 will be opened to allow fluid to travel back to reservoir 110 via passage 115. This occurs when the pressure in passage 165 is so high during the second stage that it prevents the ball of the high pressure outlet check valve 170 from moving, so that with additional pumping, the pressure in passage 115 before the high pressure relief valve increases until the preset pressure of the pump will cause the high pressure relief valve to open. If there was no pressure relief valve 195, the high pressure in the hydraulic system could damage the pump or any system in fluid communication with the pump.

After the desired work is completed, the operator can open the oil return valve 192 so that fluid from the piston/cylinder assembly can flow through the pump outlet 105 to passage 107, through the oil return valve 192 and passage 115 and finally to the reservoir 110. Because the ball of both the low pressure outlet check valve 185 and the high pressure outlet check valve 170 are biased closed, the fluid from the pump outlet 105 can only flow to the reservoir, as just described.

Figure 2:
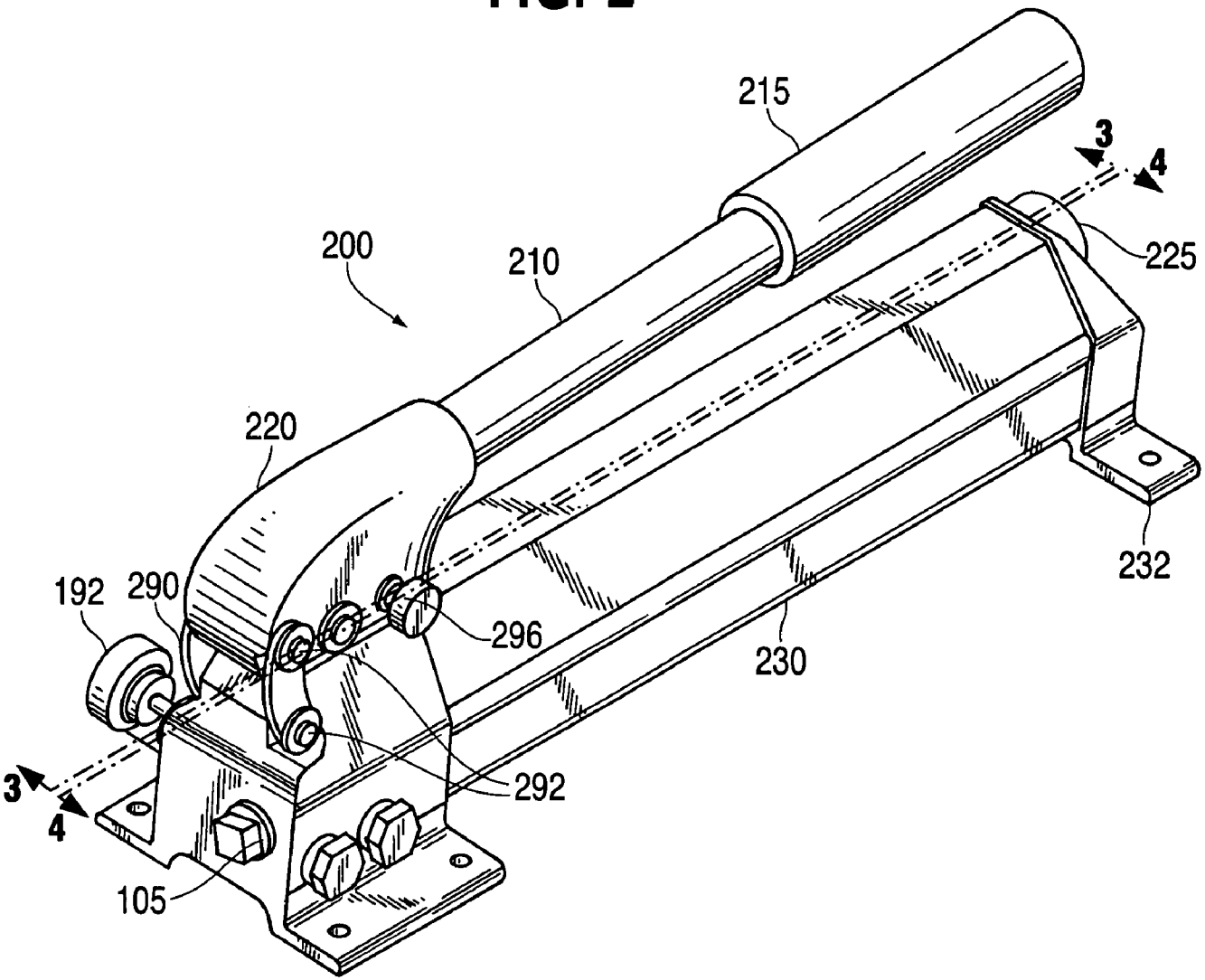
FIG. 2 is an isomeric view of an embodiment of a two-stage pump according to a preferred embodiment of the invention.

FIG. 2 is an isomeric view of an embodiment of a two-stage pump 200 according to an embodiment of the invention. The two-stage pump 200 includes a handle 210 attached to a housing 230 having feet 232. The feet 232 help to stabilize the two-stage pump 200 during pumping operation. The feet 232 can be coupled to the housing 230 or can be integrally connected with the housing. The handle includes a grip 215 for gripping by the operator's hand. The grip 215 can be made from any material that allows the operator's hand to comfortably grip the handle 210 during a pumping operation of the two-stage pump 200. The handle 210 further includes a handle head 220 that is pivotally connected by links 290 and pivot pins 292 to the housing 230. The handle 210 can be locked through the interaction of a lock plunger 296 located in the handle head 220 with lock screw 298 (See FIG. 3).

The housing 230 further includes an outlet port 105 where the two-stage hand pump 200 can connect to another device, such as a piston/cylinder assembly. The outlet port 105 allows hydraulic fluid under pressure from the pumping of the handle to be transferred to the piston/cylinder assembly that is doing the work. After the work is completed, the operator can open the oil return valve 192 to allow hydraulic fluid from the piston/cylinder assembly to return to the reservoir 110 (See FIG. 3) in the two-stage hand pump 200. A fill cap 225 is provided for the operator to fill or remove the fluid in the reservoir 110, as needed.

Figure 3:
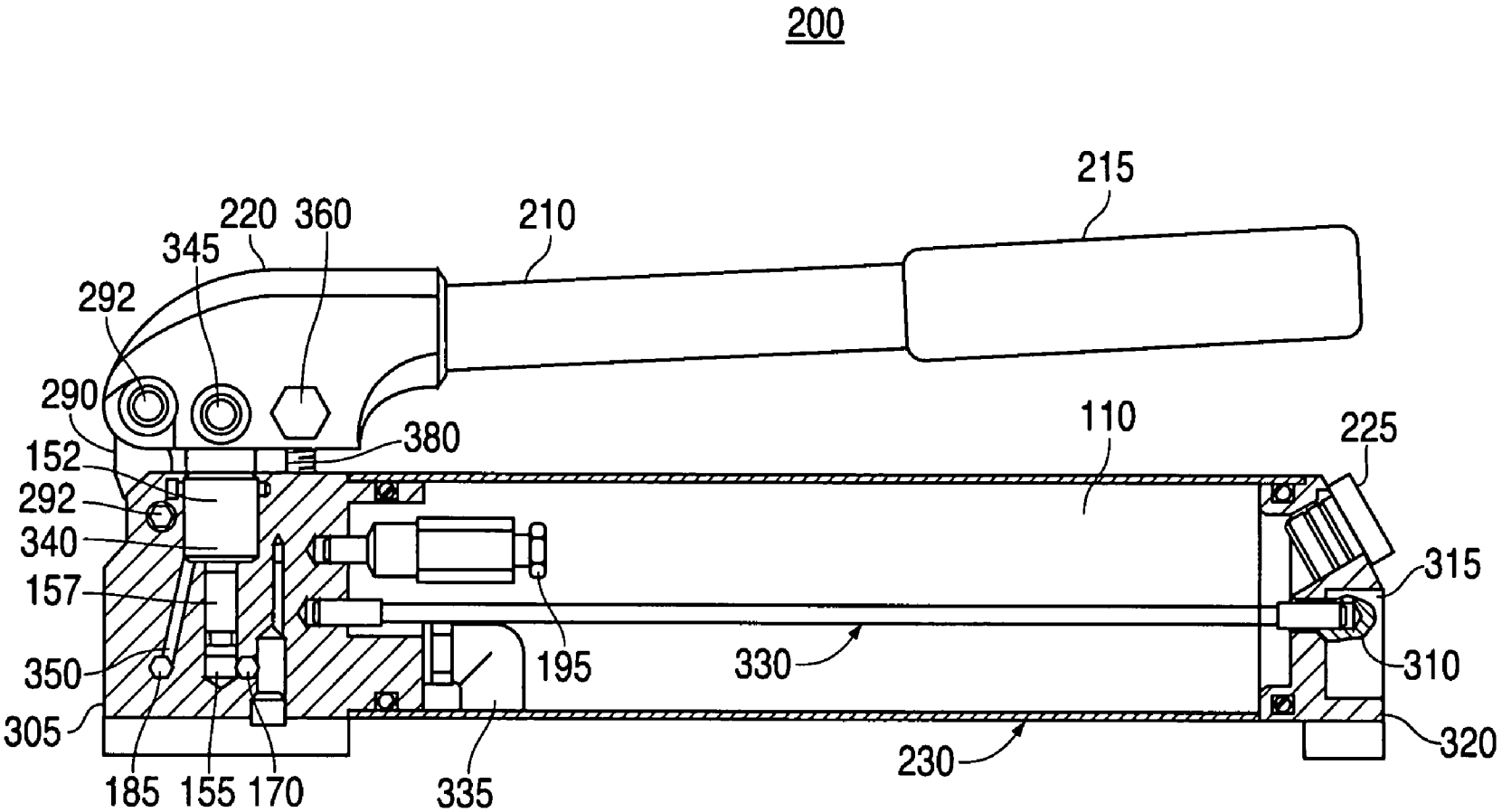
FIG. 3 is a cross-sectional view of the two-stage hand pump taken along the 3-3 of FIG. 2.

FIG. 3 a cross-sectional view of the two-stage hand pump 200 taken along the 3-3 in FIG. 2. As stated above, the two-stage hand pump 200 includes the handle 210 having the grip 215 on one end and the handle head 220 at another end. The handle 210 is pivotally connected via the handle head 220 to the housing 230 through the links 290 and the pivot pins 292. In this view, the pivot pins 292 are also received in a pump head 305 and connect links 290 to the pump head.

Through the use of the links 290 and the pivot pins 292, the pivot pin 292 in handle 210 can transverse closer to piston 340 thereby gaining greater mechanical advantage requiring less effort to pump the handle 210 at certain handle angles, than if the handle 210 is simply connected to the pump head via pivot pins. In conventional pivot connection, since the distance between the handle pivot and the piston 340 is further, it has less mechanical advantage and will require more effort from the user. By using links, greater mechanical advantage can be realized requiring less pumping effort from the user.

Also contained in the handle head 220 is a locking mechanism 500 (discussed below) that includes a lock plunger 296 that interacts with a lock screw 380. Through this interaction, the handle 210 can be locked in the down position when not in use.

A tie rod 330 keeps the two-stage hand pump 200 together by mating with the pump head 305 on one end and a tie rod nut 310 located in a recessed portion 315 of an end cap 320 at the other end. The tie rod 330 can have threads thereon for mating with the pump head 305 and end cap 320. The housing 230 is positioned between the pump head 305 and the end cap 320 so that the tie rod 330 is constructed and arranged to keep the pump head 305, the housing 230 and the end cap 320 together.

The construction of the recessed portion 315 in the end cap 320 allows for more volume for the reservoir 230 for a given length of the pump. Because conventional pumps have the tie rod nut 310 on the outermost surface, the area around the nut is wasted area that could have been used to extend the reservoir while keeping the same length requirement for a two-stage hand pump 200. In the current embodiment, more reservoir space is available for fluid than conventional hand pumps having the nut on the outermost surface of the housing.

The removable fill cap 225 is provided on the outer surface of the housing 230 to allow the operator to add fluid to the reservoir 230. The fill cap 225 can be threaded or pressed fitted into a locking position to protect the reservoir from becoming contaminated. The fluid used herein can be any fluid that can be used in a hand pump, such as hydraulic fluid, water, oil, automatic transmission fluid, or the like.

Positioned in the reservoir is the high pressure relief valve 195 that opens when too much pressure is present in the hydraulic system of the two-stage hand pump. The maximum pressure can be any pressure desired by the operator, including, for example, around 10,000 pounds per square inch. The high pressure relief valve 195 helps to prevent damage to the two-stage hand pump 200 should too much pressure is built up in the hydraulic system. In operation, when the pressure in the hydraulic system exceeds the preset maximum pressure, then the relief valve opens and allows the fluid to return to the reservoir 110.

Also positioned in the reservoir 110 is an inlet elbow 335 where the fluid is allowed to move into the hydraulic system of the pump. The inlet elbow's opening is near the bottom of the reservoir 110 to take advantage of using as much fluid as possible. Within the inlet, is the filter 125 (not shown) for filtering the contaminants that may be in the reservoir 110.

The pump head 305 includes the main hydraulic system used by the hand pump 200. Within the pump head shown in FIG. 3 is a piston 340, low pressure inlet check valve (135 in FIGS. 1 and 185 in FIG. 3) and high pressure inlet check valve (160 in FIGS. 1 and 170 in FIG. 3), and high pressure piston reservoir 155. The piston 340 can be divided into the low pressure piston 152 and the high pressure piston 157. Additionally, the piston 340 can be connected to the handle head 220 via piston pins 345, so that when the handle 210 is raised, the piston 340 will also be raised. The low pressure piston 152, once lifted, will move and increase the volume of the low pressure chamber 150 (not shown) that can accept fluid via a low pressure passage 145 due to a vacuum created by the low pressure piston being lifted. Similarly, the high pressure piston 157, once lifted will move and increase the volume of the high pressure chamber 155 that can accept fluid due to a vacuum created by the high pressure piston being lifted. The relative vacuum created by the low and high pressure pistons move the balls in the low and high pressure inlet check valves 135 and 160, respectively, that are normally biased in closed position by springs (not shown) gravity and/or pressure to allow fluid to enter the low and high pressure chambers.

Figure 4:
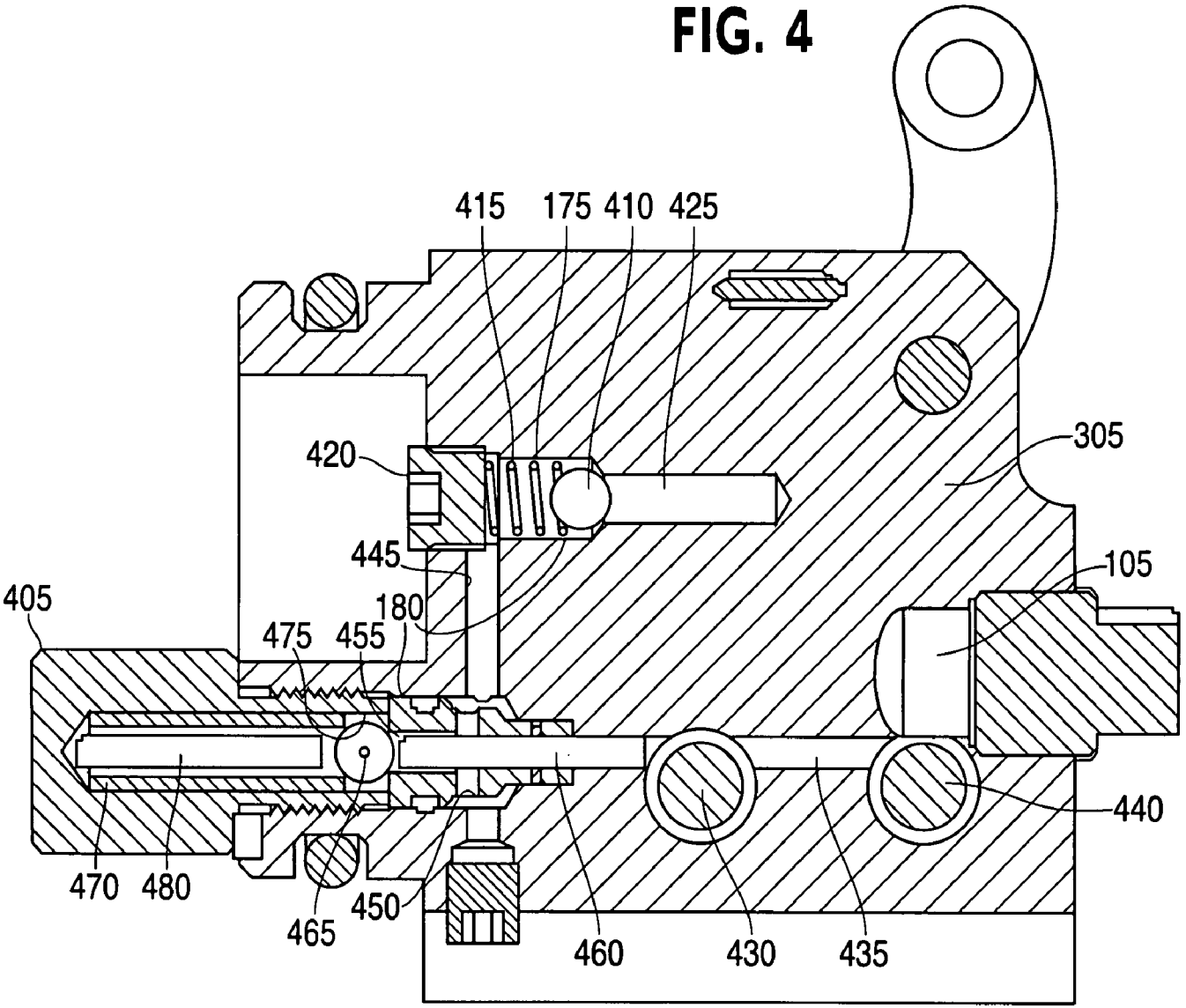
FIG. 4 is a cross-sectional view of the pump head portion of the two-stage hand pump taken along the 4-4 of FIG. 2.

FIG. 4 is a cross-sectional view of the pump head portion of the two-stage hand pump 200 taken along the 4-4 in FIG. 2. This figure illustrates the unloading assembly 180 and back flow check valve 175 that can be utilized in the second stage of pumping. The purpose of the unloading assembly 180 is to increase the volume of oil and maximum pressure of oil pumped in first stage operation. During second stage operation, the unloading valve decreases the effort required to pump the handle. As previously stated, the conventional two-stage hand pump uses a direct-acting relief valve. During the second stage, the conventional hand pump utilizes a direct-acting relief valve to relieve the first stage pressure and return the fluid back to the reservoir. However, the use of the direct-acting relief valve is inefficient because during the second stage, every stroke requires additional force by the operator to open the relief valve to return the low pressure fluid to the reservoir, thus some of the pumping effort by the operator is lost in order to return the fluid to the reservoir. Additionally, the conventional direct-acting relief valve typically starts to open at around 200 p.s.i., thus the work that can be done by the fluid in the lower pressure chamber is decreased and the conventional two-stage hand pump will shift into the second stage faster and thereby pump less oil per stroke, as compared to a pump with an unloading assembly.

Turning to FIG. 4, the unloading valve assembly 180 and the back flow check valve 175 are contained in the pump head 305. As stated above in FIG. 1, the back flow check valve 175 is used to prevent air in the reservoir 110 from entering the piston chambers, which will decrease the amount of oil pumped per stroke, and could damage the hydraulic system being pumped. Air can flow into the system if the oil level in the reservoir is low. Alternatively, the back flow check valve 175 can also prevent contaminated fluid from flowing into the piston chambers from the reservoir because this fluid does not flow through a filter like when the fluid flows through the inlet elbow. Air and fluid from the reservoir can flow into the unloading valve assembly via a connection (not shown) to the reservoir in an unloading valve housing 405 but will not flow past the back flow check valve 175.

The back flow check valve 175 includes a ball 410 that is normally biased in a closed position by a first spring 415 supported by a plug 420. The ball 410 seals against an opening in passage 425 and prevents fluid from flowing into said passage, which leads to the piston chambers.

During the first stage and the second stage operations, a high pressure ball 430 (part of the high pressure outlet check valve) will move so that fluid from the high pressure piston chamber will enter passage 194, which leads to pump outlet 105. Additionally, in the first stage operation, a low pressure ball 440 (part of the low pressure outlet check valve) will also move so that fluid from the low pressure chamber can flow into the pump outlet 105. The low pressure ball 440 will not move during the second stage operation.

During the second stage operation, the fluid from the lower piston chamber will flow into passage 425, and pushes the ball 410 to the left, thereby allowing fluid to flow down a passage 445 to passages 450 and 455. Received in passage 455 is piston 460 that can be moved (left) by fluid pressure in passage 194 supplied around high pressure ball 430. The pressure of the fluid supplied around high pressure ball 430 moves the piston 460 to the left, thereby moving an unloading valve ball 465 that is biased closed by a second spring 470. The movement of the unloading valve ball 465 allows fluid from passage 455 to move into a passage 475 formed in the unloading valve housing 405 and ultimately into the reservoir. The unloading valve ball 465 movements to the left is impeded by a stop member 480, which is provided to prevent spring 470 from being permanently deformed and to limit the movement of piston 460.

A person skilled in the art would recognize that unloading valve as described herein may be any type of pilot operated dump valve in a hydraulic hand pump that can be used to relieve lower stage pressure while operating in higher stages. Additionally, the pilot operated dump valve could be any type of relieve valve that opens based on a pressure external to the pressure of the fluid that would flow through the open relief valve. Further, a ball in the unloading valve or any valve described herein can be any type of valve and may or may not include a ball, including any type of valve poppet in place of the ball.

Figure 5:
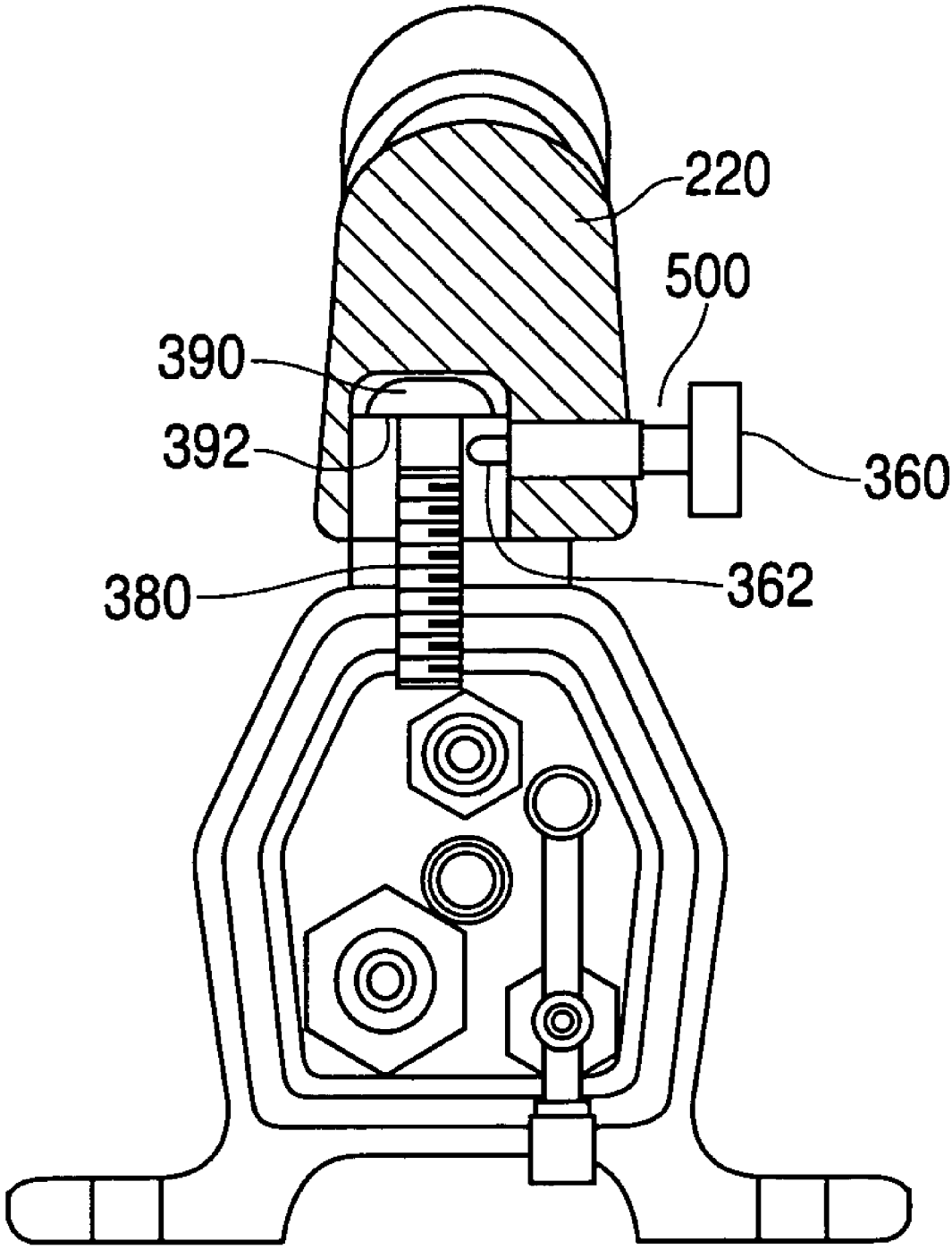
FIG. 5 illustrates a locking assembly for a two-stage hand pump.

FIG. 5 illustrates a locking assembly 500 for a two-stage pump 200. The locking assembly includes the lock plunger 360 (296 in FIG. 2), which is retractable and rotatable, located in the handle head 220 and the lock screw 380 protruding from pump head. The lock screw 380 can include threads on the outer surface to mate with complementary threads in the pump head.

The lock plunger 360 includes a locking end 362 that engages a lower portion 392 of the head 390 of the lock screw 380 when the handle is in the locked position, as shown. The locking end 362 can include an end that is flat in order to engage the lower portion 392 of the head 390. With the locking end 362 engaging under the lower portion 392 of the screw head 390, the handle is prevented from moving.

In order to unlock, the operator can pull the retractable lock plunger 360 and the locking end 362 disengages from the lower portion 392 of the screw top. This allows the handle to move so that the user can pump the handle. By having the locking feature, the operator can easily carry the hand pump using the handle. Conventional handle locks may be awkward to use or prone to damage or misplacement.

Although the lock screw described herein may be a lock screw, any other lock device can be used, such as a fastener, pin and other similar devices. Additionally, the locking screw and lock plunger can be made of any suitable material, for example, metal, plastic, composite, alloy, and others.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A hand pump having a locking mechanism, comprising:

a handle pivotably attached to a housing of the pump and having a handle head;

a lock plunger at least partially received within the handle head and having a locking end; and a lock screw having a head portion that interacts with the locking end of the lock plunger and is at least partially received in the housing, wherein the locking end can interact with the head portion of the lock screw to prevent the handle from moving away from the housing.

2. The hand pump of claim 1, wherein the head portion of the lock screw is received within the handle head.

3. The hand pump of claim 1, wherein the locking end of the lock plunger interacts with a lower portion of the head screw to prevent the handle from moving.

4. The hand pump of claim 1, wherein the lock plunger is rotatable and retractable in order to prevent the locking end of the lock plunger from interacting with the head portion of the lock screw.

5. The hand pump of claim 1, wherein the lock plunger is retractable so that when retracted, the locking end of the lock plunger is prevented from interacting with the head portion of the lock screw.

6. The hand pump of claim 1, wherein the locking end of the lock plunger includes a flat surface to interact act with the head portion of the lock screw.

7. The hand pump of claim 1, wherein the locking end of the lock plunger interacts with the head portion of the lock screw within the handle head.

8. The hand pump of claim 1, wherein the lock screw includes threads on the outer surface that mates with threads in the housing.

9. A handle locking method for a hand pump, comprising:

moving a handle towards a housing of the hand pump to a lock position;

moving a lock plunger in a first direction to engage a lock screw that is partially received in the housing; and locking the handle with a locking end of the lock plunger that engages the lower portion of the lock screw.

10. The locking method of claim 9, further comprising moving the lock plunger in a second direction to disengage the lock plunger from the lock screw.

11. The locking method of claim 9, wherein the lock plunger includes a flat surface to interact act with a head portion of the lock screw.

12. The locking method of claim 9, wherein the locking end of the lock plunger interacts with the head portion of the lock screw within a handle head.

13. A hand pump with a locking system, comprising:

a means for pumping that is pivotably attached to a means for housing of the pump and having a head means;

a means for locking at least partially received within the head means and having a locking end; and a means for securing having a head portion that interacts with the locking end of the means for locking and is partially received in the means for housing, wherein the locking end can interact with the head portion of the means for securing to prevent the means for pumping from moving away from the housing.

14. The hand pump of claim 13, wherein the head portion of the means for securing is received within the head means.

15. The hand pump of claim 13, wherein locking end of the means for locking interacts with a lower portion of the head portion of the means for securing to prevent the means for pumping from moving.

16. The hand pump of claim 13, wherein the means for locking is rotatable and retractable in order to prevent the locking end of the means for locking from interacting with the head portion of the means for securing.

17. The hand pump of claim 13, wherein the means for locking is retractable so that when retracted, the locking end of the means for locking is prevented from interacting with the head portion of the means for securing.

18. The hand pump of claim 13, wherein the locking end of the means for locking includes a flat surface to interact act with the head portion of the means for securing.

19. The hand pump of claim 13, wherein the locking end of the means for locking interacts with the head portion of the means for securing within the head means.

20. The hand pump of claim 1, wherein the means for securing includes threads on the outer surface that mates with threads in the means for housing.

* * * * *